US007849640B2

(12) United States Patent
Rice

(10) Patent No.: US 7,849,640 B2
(45) Date of Patent: Dec. 14, 2010

(54) TRACK FOR METAL STUD WALLS

(75) Inventor: John Rice, Aurora (CA)

(73) Assignee: Bailey Metal Products Limited, Concord, ON (CA)

( * ) Notice: Subject to any disclaimer, the term of this patent is extended or adjusted under 35 U.S.C. 154(b) by 0 days.

(21) Appl. No.: 11/364,202

(22) Filed: Mar. 1, 2006

(65) Prior Publication Data

US 2007/0193202 A1 Aug. 23, 2007

(30) Foreign Application Priority Data

Mar. 2, 2005 (CA) ..... 2499227

(51) Int. Cl.
*E04B 2/58* (2006.01)
*G01B 5/16* (2006.01)

(52) U.S. Cl. ..... 52/105; 52/241; 52/656.9; 52/243; 33/483; 33/613

(58) Field of Classification Search ..... 52/241, 52/242, 105, 733.2, 733.3, 243, 656.9, 93.1, 52/690, 696, 481.1, 481.2; 33/1 F, 404, 783, 33/792, 613, 645, 562, 566, 679.1, 483, 492, 33/494

See application file for complete search history.

(56) References Cited

U.S. PATENT DOCUMENTS 1,814,202 A * 7/1931 Winget ..... 403/274
2,528,211 A * 10/1950 Civkin et al. ..... 434/80
3,224,156 A * 12/1965 Marchand ..... 52/660
3,423,893 A * 1/1969 Hyatt ..... 52/241
3,486,281 A * 12/1969 Gregoire ..... 52/127.1
3,536,345 A 10/1970 Leifer
3,680,271 A 8/1972 Satchell
3,831,333 A * 8/1974 Nelsson et al. ..... 52/241
4,016,700 A * 4/1977 Blomstedt ..... 52/733.3
4,074,495 A * 2/1978 Bodnar ..... 52/630
4,074,498 A * 2/1978 Keller et al. ..... 52/690
4,805,364 A 2/1989 Smolik
4,809,476 A 3/1989 Satchell
4,854,096 A 8/1989 Smolik
4,858,399 A * 8/1989 Salato, Jr. ..... 52/97
4,918,899 A * 4/1990 Karytinos ..... 52/690
5,203,132 A * 4/1993 Smolik ..... 52/241
5,222,335 A * 6/1993 Petrecca ..... 52/105
5,274,973 A * 1/1994 Liang ..... 52/243
5,325,651 A * 7/1994 Meyer et al. ..... 52/715
5,394,665 A 3/1995 Johnson
5,660,012 A 8/1997 Knudson
5,797,233 A * 8/1998 Hascall ..... 52/481.1
6,205,740 B1 * 3/2001 Ekerholm et al. ..... 52/733.2
6,568,138 B1 * 5/2003 Frost et al. ..... 52/241
2002/0023402 A1 * 2/2002 Winchester ..... 52/474

* cited by examiner

*Primary Examiner*—Robert J Canfield
*Assistant Examiner*—Jessie Fonseca

(57) ABSTRACT

The present invention provides for track for use in constructing metal stud walls. The track is a generally U-shaped channel having a base and upstanding side walls extending along either side of the base. The base is provided with a plurality of embossed indicator means evenly spaced along the length of the base. The spacing of the embossed indicator means provides a guide for the proper spacing of the studs placed in the base.

15 Claims, 3 Drawing Sheets

TRACK FOR METAL STUD WALLS

FIELD OF THE INVENTION

The present invention is directed to track for use in metal stud walls and particularly to a track which increases the ease of installation of metal stud walls.

BACKGROUND OF THE INVENTION

Metal stud walls are commonly used, especially in commercial, institutional and industrial construction, because of their fire resistance and non-warping characteristics. Such stud walls generally have a bottom and top track attached to the floor and ceiling respectively and a plurality of spaced apart studs extending vertically between the tracks. In a typical installation, the studs are spaced 16 or 24 inches apart to accommodate the 4 foot widths of wall covering material such as drywall or other sheets. In order to make the installation of the studs easier, a number of tracks have been developed with one or more structures on the upstanding walls of the track that hold the studs in the track at the proper spacing. Examples of such structures are shown in U.S. Pat. No. 3,423,893 issued Jan. 28, 1969 to Hyatt; U.S. Pat. No. 3,536,345 issued Oct. 27, 1970 to Leifer; U.S. Pat. No. 3,680,271 issued Aug. 1, 1972 to Satchell; U.S. Pat. No. 4,805,364 issued Feb. 21, 1989 to Smolik; U.S. Pat. No. 4,809,476 issued Mar. 7, 1989 to Satchell; U.S. Pat. No. 4,854,096 issued Aug. 8, 1989 to Smolik; U.S. Pat. No. 5,222,335 issued Jun. 29, 1993 to Petrecca; U.S. Pat. No. 5,325,651 issued Jul. 5, 1994 to Meyer and Sardjono; U.S. Pat. No. 5,394,665 issued Mar. 7, 1995 to Johnson; and U.S. Pat. No. 5,660,012 issued Aug. 26, 1997 to Knudson among others. Such designs of tracks do suffer drawbacks in that the additional structure increases the costs of manufacturing the track. In addition, should the stud have to be installed in a position other than the regular spacing, there is no support structure provided and the installer has to once again measure for the placement of the stud.

SUMMARY OF THE INVENTION

The present invention provides for a metal track for use in constructing metal stud walls. The track is a generally U-shaped channel having a base and upstanding side walls extending along either side of the base. The base is provided with a plurality of embossed indicator means evenly spaced along the length of the base. The spacing of the embossed indicator means provides a guide for the proper spacing of studs to be placed in the base.

In an aspect of the invention, the spacing between the embossed indicator means on the base is 1".

In another aspect of the invention, the embossed indicator means are spaced 4" apart on the base.

BRIEF DESCRIPTION OF THE DRAWINGS

Preferred embodiments of the present invention are shown in the attached drawings wherein.

DETAILED DESCRIPTION OF THE PREFERRED EMBODIMENTS

Figure 1:
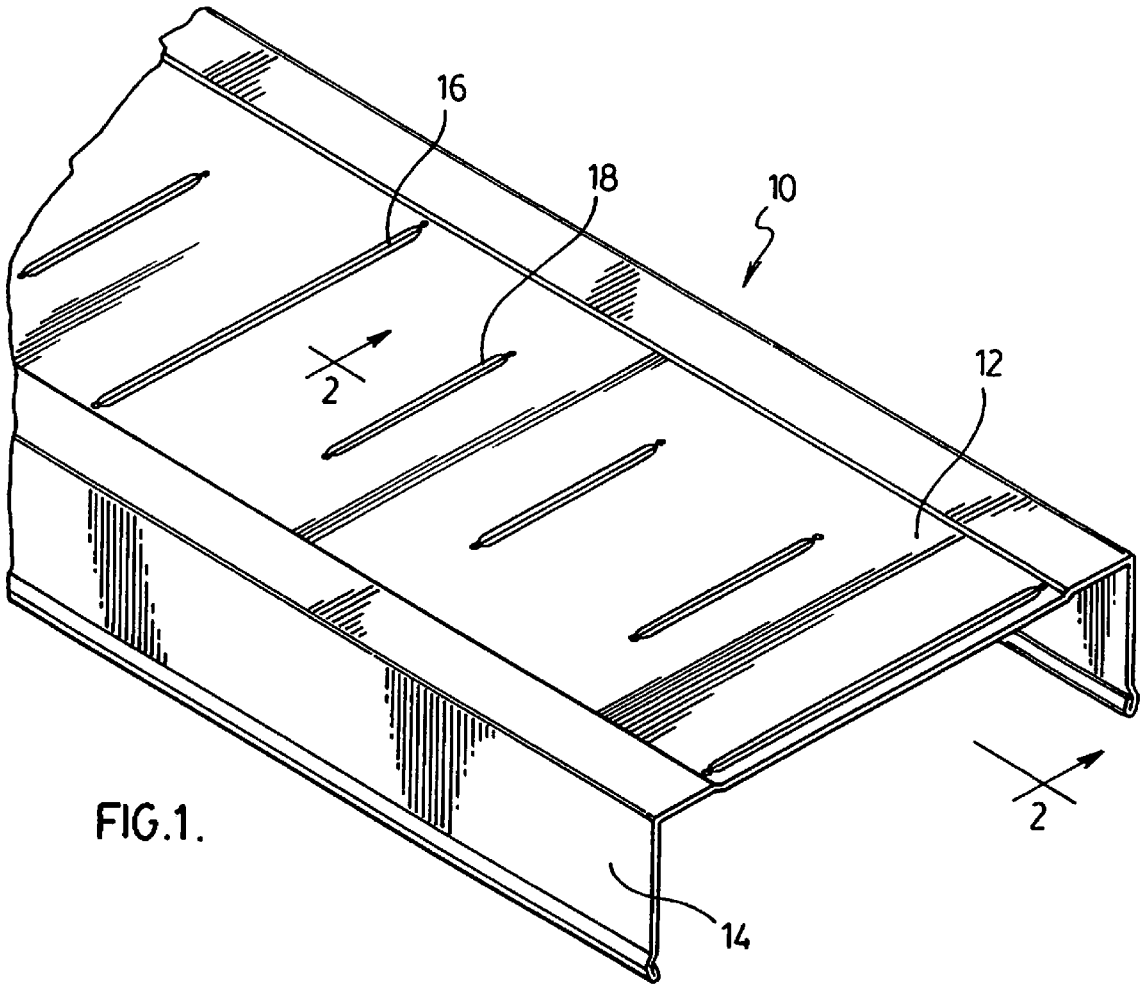
FIG. 1 is a perspective view of a section of a first embodiment of a track of the present invention.
Figure 2:
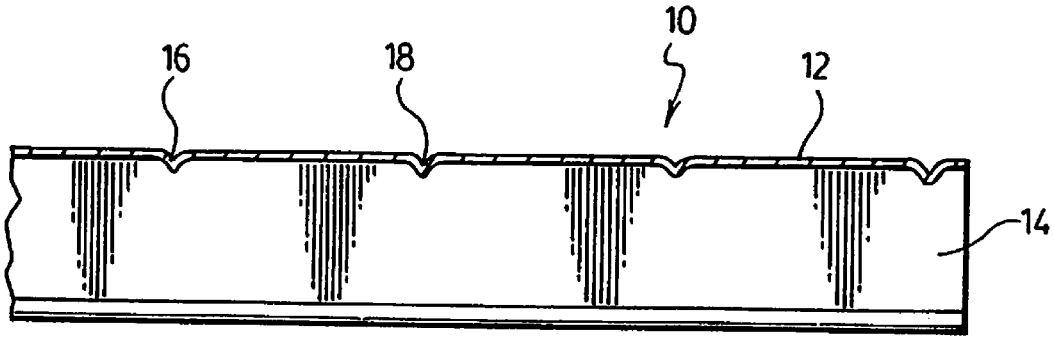
FIG. 2 is a side elevation view in cross-section of the track of FIG. 1.

A first preferred embodiment of a track for use in metal stud walls is illustrated in FIGS. 1 and 2, generally indicated by the numeral 10. Track 10 has a base 12 and two upstanding side walls 14 extending along either side of the base 10. Base 12 is provided with a plurality of embossed indicator means 16 and 18 evenly placed along the length of the base 12. The spacing of the indicator means 16 and 18 provides a guide for the proper spacing of studs 20 placed in the track 10 as described below.

Figure 3:
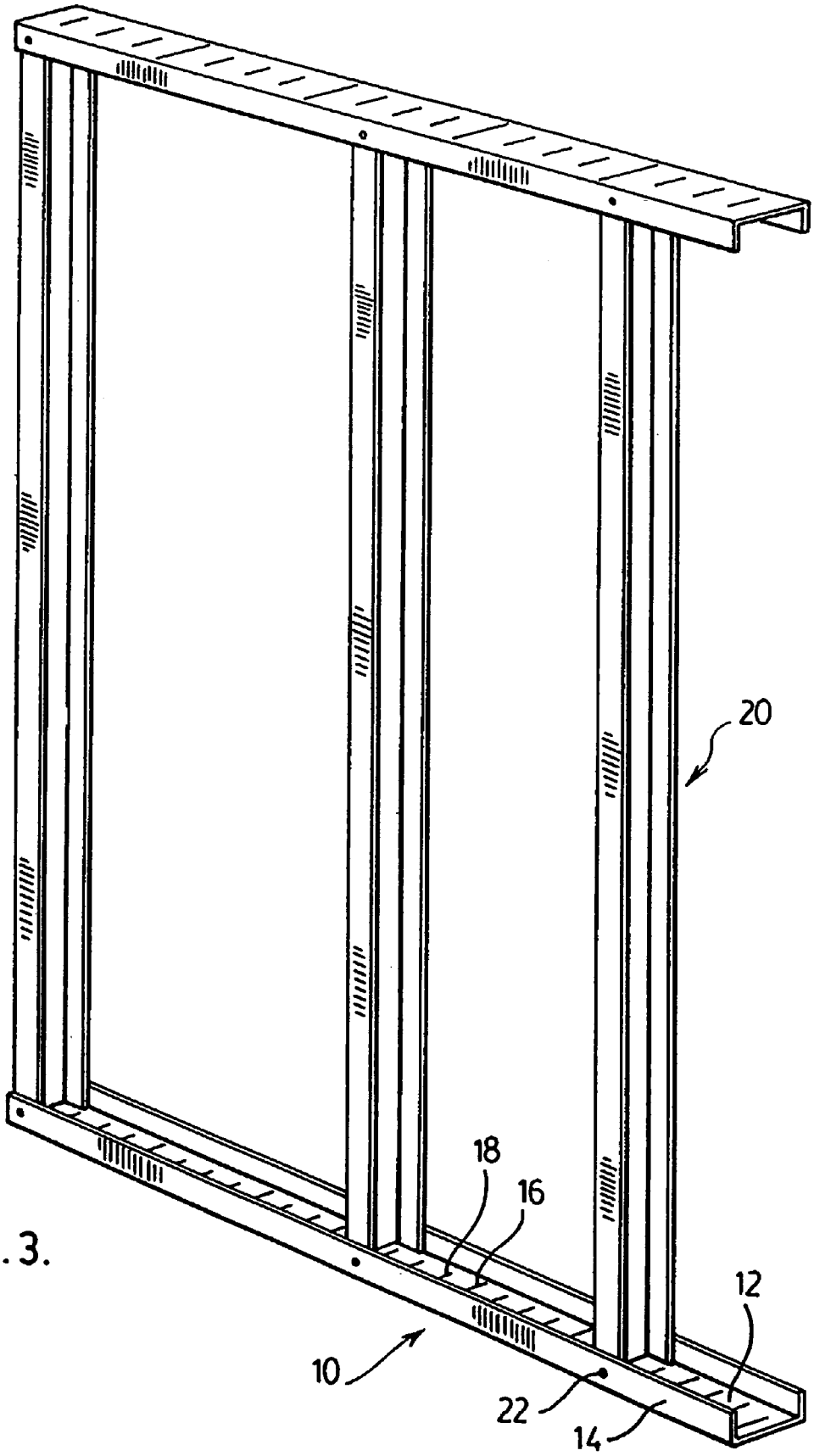
FIG. 3 is a perspective view of a section of a metal stud wall constructed utilizing the track of FIG. 1.

The use of the track 10 of the present invention for construction of a metal stud wall is illustrated in FIG. 3. In a typical construction of a metal stud wall, the bottom and top tracks 10 are generally fastened to the floor and ceiling respectively and the vertical studs 20 bridging the two tracks 10 are placed in the channels of the tracks 10 and fastened to the tracks 10. In order to fasten the tracks 10 to the floor and ceiling respectively, the track 10 is positioned in the proper position against the floor or ceiling and screwed into the floor and ceiling. Once the tracks 10 are fastened to the floor and ceiling, the metal studs 20 are placed in the tracks 10 and properly positioned for the spacing required. By utilizing the embossed indicating means 16 and 18 on the bottom and top track 10, the proper spacing of the studs 20 is easily accomplished by aligning the studs 20 with the embossed indicating means 16 or 18 located at the desired distance apart. Once the studs 20 have been properly placed in the track 10, they are fastened to the track 10 using suitable fasteners such as self-tapping metal screws 22.

The spacing of the indicator means 16 and 18 on the base 12 of the track 10 is selected to provide proper spacing to act as a guide for the location of the studs 20 in the completed wall. The typical spacing of studs 20 in completed walls are either 12, 16 or 24 inches on center. In order to provide the proper spacing between them, a first embossed indicator means 16 is selected to provide 12, 16 or 24 inches as a multiple of the spacing. Preferably, embossed indicator means 16 are located 4 inches apart, thus providing for a guide for any multiple of 4 inches spacing by utilizing the properly spaced apart embossed indicator means 16. Thus, by selecting every third, fourth or sixth embossed indicator means 16 respectively, the spacings of 12, 16 and 24 inches on center for the studs 20 may be easily located.

A second embossed indicator means 18 is provided intermediate the first embossed indicator means 16 to provide for greater flexibility in the management of the distance along the track to which the stud is to be attached. Preferably, the second embossed indicator means 18 are spaced 1 inch apart, thus providing a ready made inch ruler along the base of the track 10.

In the embodiment illustrated in FIGS. 1 to 3, the embossed indicator means 16 and 18 are elongated embossed lines extending across the base 12. In order to differentiate the first indicator means 16 from the second indicator means 18, it is preferred if the length of the first and second indicator means 16 and 18 are different. Thus, preferably, the first indicator means 16 has a length greater than the second indicator means 18. More preferably, the length of the first indicator means 16 is at least half the width of the base and length of the second indicator means 18 is less than half the width of the base 12.

Figure 4:
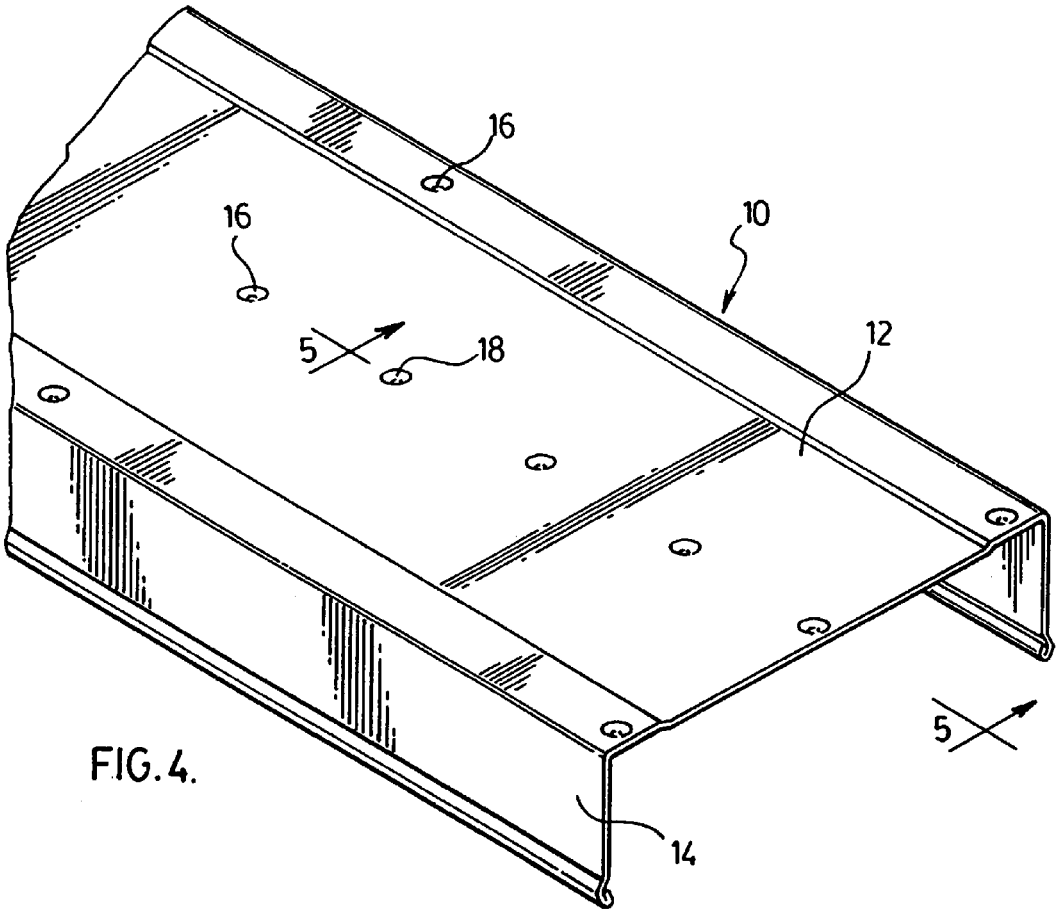
FIG. 4 is a perspective view of a section of a second embodiment of a track of the present invention.
Figure 5:
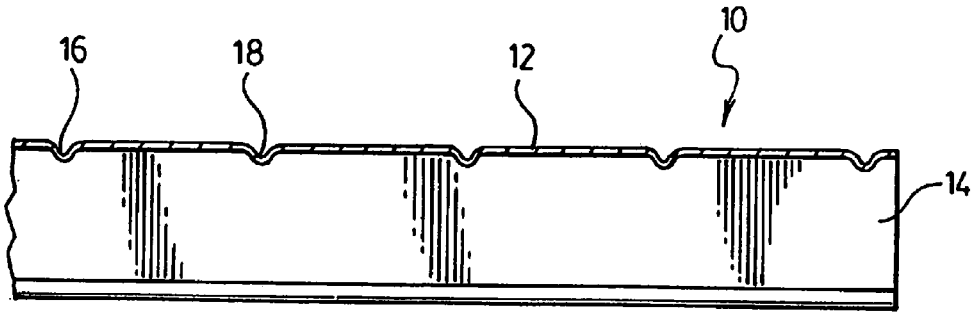
FIG. 5 is a side elevation view in cross section of the track of FIG. 4.
Figure 6:
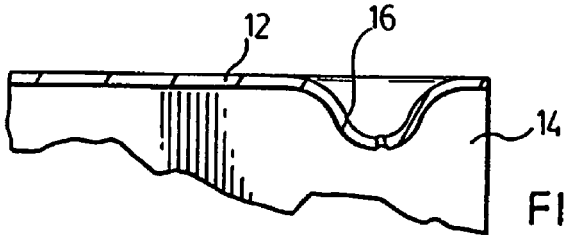
FIG. 6 is a side elevation view in detail showing the embossed indicating means of the track of FIG. 4.

A second embodiment of a track 10 of the present invention is illustrated in FIG. 4. In contrast to the first embodiment where the embossed indicator means were linear lines across the base 12, the embodiment illustrated in FIG. 4 utilizes circular punches 30 and 32 as the first and second embossed indicator means. Thus, a first series of embossed punches 30 are spaced 4 inches apart while a second series of embossed punches 32 are spaced 1 inch apart.

In this embodiment the first and second embossed indicator means 16 and 18 are differentiated one from another by providing them in different locations along the base 12 of the track 10. For example, as illustrated in the figure first embossed indicator means 30 are provided along the edge of the base 12 of the track 10 while second embossed indicator means 32 are provided along the centre of the base 12 of the track 10. Other ways of differentiating the embossed indicator means one from the other may also be provided such that different sizes of circular punches for each of the two indicator means or the number of circular punches for each of the indicator means. Thus, the first indicator means could be provided by two circular punches in the center of the base 12 of the track 10 beside each other while the second indicator means could be provided as a single circular punch in the base of the track 10.

The indicator means may also be provided in other ways. For example, suitable printing means may be used to print the indicator means along the interior of the track on the base or exterior on the side wall of the track. Preferably, this printing is accomplished by ink jet printing utilizing an ink which will adhere to the metal of the web of the track.

The track of the present invention provides the advantage that the installation and erection of metal stud walls and buildings is made easier and quicker for the installer. The embossed indicating means located in the base of the track provide a guideline for the proper spacing of the studs located in the stud wall by being able to easily locate the studs in the stud walls at their proper position. The installer's job is thus made easier as he does not have to measure to locate each stud in the proper spacing of the adjacent stud.

Although various preferred embodiments of the present invention have been described herein in detail, it would be appreciated by those skilled in the art that variations may be made thereto without departing from the spirit of the invention or the scope of the appended claims.

The embodiments of the invention in which an exclusive property or privilege is claimed are defined as follows:

1. A track for use in constructing metal stud walls, comprising a generally U-shaped channel having a base and upstanding side walls extending along either side of the base, the base having opposed support channels at said side walls connected by a raised inwardly offset web, the U-shaped channel being of a size to accept and securely hold a metal stud within the channel, the upstanding side walls being of a size to extend substantially above said offset web and abut and securely hold a flange of a metal stud by allowing a fastening means to penetrate the upstanding side wall and abutting flange of the metal stud and securely hold the upstanding side wall and the flange together, the base being provided with a plurality of a first and second series of embossed indicator means evenly spaced along the length of the base, the first series of embossed indicator means being visually distinct from the second series of embossed indicator means, at least one of the first and second series of embossed indicator means being located on the offset web of the base, the offset web of the base being planar and uninterrupted between the individual embossed indicator means, the spacing of the first and second series of the embossed indicator means providing a guide for the proper spacing of metal studs to be placed in the track for construction of a metal stud wall.

2. A track according to claim 1, wherein the first series of embossed indicator means are provided on the base spaced 4 inches apart.

3. A track according to claim 2, wherein the second series of embossed indicator means are provided between each of said first embossed indicator means spaced 1 inch apart.

4. A track according to claim 2, wherein said first embossed indicator means are elongated embossed lines extending across the base.

5. A track according to claim 4, wherein said elongated embossed lines extend across at least half the width of the base.

6. A track according to claim 3, wherein said first and second embossed indicator means are each elongated embossed lines extending across the base, the length of the embossed lines of said first embossed indicator means being greater than the length of the embossed lines of said second embossed indicator means.

7. A track according to claim 2, wherein the first embossed indicator means are embossed circular punches in the base.

8. A track according to claim 3, wherein the first and second embossed indicator means are each embossed circular punches in the base, the size or orientation of the circular punches of one of the first or second embossed indicator means being different from the other to differentiate the first and second embossed indicator means from one another.

9. A metal stud wall comprising a top and bottom track and a plurality of spaced apart metal studs bridging the top and bottom track, each of the metal studs comprising a C-shaped member with a pair of opposed flanges, a central web joining the flanges along opposing edges of the central web, the top and bottom tracks comprising a generally U-shaped channel having a base and upstanding side walls extending along either side of the base, the base having opposed support channels said side walls connected by a raised inwardly offset web, the U-shaped channel securely holding the metal stud within the channel, the upstanding side walls abutting and securely holding the flanges of each metal stud, a fastening means penetrating the upstanding side walls and abutting flanges of each metal stud and securely holding the upstanding side walls and the flanges together the base being provided with a plurality of a first series and a second series of embossed indicator means evenly spaced along the length of the base, the first series of embossed indicator means being visually distinct from the second series of embossed indicator means, at least one of the first and second series of embossed indicator means located on the offset web of the base, the offset of the base being planar and uninterrupted between the individual embossed indicator means, the spacing of the first and second series of embossed indicator means providing a guide for the proper spacing of metal studs in the metal stud wall.

10. A metal stud wall according to claim 9, wherein the first series of embossed indicator means are provided on the base spaced 4 inches apart.

11. A metal stud wall according to claim 10, wherein the second series of embossed indicator means are provided between each of said first embossed indicator means spaced 1 inch apart.

12. A metal stud wall according to claim 10, wherein said first embossed indicator means are elongated embossed lines extending across the base.

13. A metal stud wall according to claim 12, wherein said elongated embossed lines extend across at least half the width of the base.

14. A metal stud wall according to claim 11 wherein said first and second embossed indicator means are each elongated embossed lines extending across the base, the length of the embossed lines of said first embossed indicator means being greater than the length of the embossed lines of said second embossed indicator means.

15. A metal stud wall comprising a top and bottom track and a plurality of spaced apart metal studs bridging the top and bottom track, each of the metal studs comprising a C-shaped member with a pair of opposed flanges, a central web joining the flanges along opposing edges of the central web, the top and bottom tracks comprising a generally U-shaped channel having a base and upstanding side walls extending along either side of the base, the U-shaped channel securely holding the metal stud within the channel, the upstanding side walls abutting and securely holding the flanges of each metal stud, a fastening means penetrating the upstanding side walls and abutting flanges of each metal stud and securely holding the upstanding side walls and the flanges together, the base being provided with a plurality of a first series and a second series of elongated embossed lines evenly spaced along the length of the base, the length of the first series of elongated embossed lines being greater than the length of the second series of elongated embossed lines, the first series of elongated embossed lines being provided on the base spaced 4 inches apart, the second series of elongated embossed lines s being provided between each of said first elongated embossed lines spaced 1 inch apart, the spacing of the first and second series of elongated embossed lines providing a guide for the proper spacing of metal studs in the metal stud wall.

* * * * *